US006613489B1

(12) United States Patent
Farrugia

(10) Patent No.: US 6,613,489 B1
(45) Date of Patent: Sep. 2, 2003

(54) TONER AND METHOD FOR THE PRODUCTION THEREOF

(75) Inventor: Valerie M. Farrugia, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/074,801

(22) Filed: Feb. 13, 2002

(51) Int. Cl.[7] ..... G03G 9/087

(52) U.S. Cl. ..... 430/108.2; 430/108.7; 430/137.4

(58) Field of Search ..... 430/108.2, 109.4, 430/108.7, 137.14

(56) References Cited

U.S. PATENT DOCUMENTS

| | | | | |
|---|---|---|---|---|
| 6,143,457 A | | 11/2000 | Carlini et al. | 430/110 |
| 6,187,496 B1 | * | 2/2001 | Tanikawa et al. | 430/106.6 |
| 6,348,291 B1 | * | 2/2002 | Sato | 430/108.6 |
| 6,444,389 B1 | * | 9/2002 | Ninomiya et al. | 430/110.3 |

* cited by examiner

*Primary Examiner*—John Goodrow
(74) *Attorney, Agent, or Firm*—Nixon Peabody LLP

(57) ABSTRACT

A toner includes a resin, colorant, and a silicate component bound to the toner. The silicate component can be a water-soluble cationic complex of at least one of tetraalkylammonium and tetraalkylphosphonium. A method for making the toner includes the surface treatment of the toner with a water-soluble silicate.

20 Claims, No Drawings

TONER AND METHOD FOR THE PRODUCTION THEREOF

FIELD OF THE INVENTION

The present invention relates to a method for producing toner and the toner produced therefrom. More specifically, the present invention relates to surface treating toner with silicate and the toner produced therefrom.

BACKGROUND OF THE INVENTION

Toners which contain hydrophilic functional groups on the toner surface, such as the sodio-sulfonated polyester emulsion aggregation ("EA") toners, have the disadvantage of having high humidity sensitivity. Although these toners have exhibited satisfactory charging in the low-humidity zone (≦20% relative humidity ("RH"), also known as the C-zone) and excellent fusing properties with wide fusing latitude, the tribocharge levels in the high humidity zone (≦80% RH, also known as the A-zone) are low consequently leading to large RH sensitivity ratios (20% RH to 80% RH). Previous attempts toward improving the RH ratio of polyester toners included forming a hydrophobic fluoropolymer shell by seed polymerization on the toner particle surface; however, the fusing characteristics were adversely affected due to increasing the crease minimum fusing temperature ("MFT") value 5–10° C. to the level of styrene-based EA toner MFT.

Another recent surface treatment approach used cationic tetra-alkylated phosphonium and ammonium salts to complex chemoselectively with the toner's surface sulfonate groups thereby rendering the particle surface more hydrophobic and allowing a 2-fold reduction in the tribocharging RH sensitivity. Cationic tetra-alkylated phosphonium or ammonium salts, such as stearyltributyl-phosphonium bromide ("STBP"), which complexes chemoselectively at the sites of surface-bound sulfonate groups was used to treat the toner surface at the end of the EA process.

SUMMARY OF THE INVENTION

A toner in accordance with one embodiment includes a resin, colorant, and a silicate component bound to the toner surface.

A method in accordance with another embodiment includes preparing a colloidal solution of a sulfonated polyester resin by heating water, adding a sulfonated polyester resin to the heated water, and cooling. A colorant is added to the colloidal solution, followed by heating the resulting mixture to a temperature equal to or higher than the resin glass transition temperature. An aqueous solution of either an alkaline earth metal (II) salt or a transition metal salt is added to the heated colloidal solution whereby the coalescence and ionic complexation of sulfonated polyester colloid, colorant, and metal cation occur until the particle size of the composite is about 3 to about 10 microns in volume-average diameter having a geometric distribution of from about 1.13 to about 1.23. An aqueous slurry of the toner particle composite is heated to a temperature of from about 25° C. to about 60° C. The toner particles are chemically treated in the heated aqueous slurry with an aqueous solution containing a water-soluble silicate component.

DETAILED DESCRIPTION OF THE INVENTION

This invention in embodiments thereof describes a process for chemoselective, optionally, in situ, surface treatment of sulfonated polyester EA toners dispersed in aqueous slurry. The toner particles are rendered more hydrophobic in nature with a reduced RH sensitivity ratio for tribocharging while maintaining the excellent fusing characteristics of the parent untreated toner. The silicate reagent functions as a tribocharge enhancer and flow aid. The present toners are suitable for known electrophotographic imaging methods, printing processes, including color processes, digital methods, and lithography.

Water-soluble silicates that include the cationic complexes of tetraalkylammonium and/or tetraalkylphosphonium, such as tetraethylammonium silicate ("TEASi"), tetramethylammonium silicate ("TMASi"), tetrabutylammonium silicate ("TBASi") and tetrabutylphosphonium silicate ("TBPSi"), selectively attach to the surface sulfonate groups on these toners by ion exchange. This chemical surface treatment selectively targets the anionic sulfonate moieties on the toner surface by causing cation exchange of the complexed sodium cation (or other metal cation) for the tetraalkylammonium ("TAA") or tetraalkylphosphonium cation ("TAP"). The silicate portion of the molecule is also incorporated onto the toner's surface providing good toner flow upon drying. The present invention in embodiments thereof provides enhanced triboelectric performance and reduced RH sensitivity of surface treated polyester EA toner particles, which is suitable for an in situ chemical surface treatment, using water-soluble silicates that include large organic cations such as tetraalkylammonium and/or tetraalkylphosphonium. The organic cations are optionally substituted with $C_1$ to $C_{20}$ alkyl substituents, for example, methyl, ethyl, propyl, n-butyl, sec-butyl, tert-butyl, n-pentyl, iso-pentyl, neo-pentyl, hexyl, heptyl, octyl, nonyl, decyl, undecyl, dodecyl, lauryl, tridecyl, tetradecyl, myristyl, pentadecyl, hexadecyl, cetyl, heptadecyl, octadecyl, stearyl, nonadecyl, cicosyl groups, and the like; aryl groups, for example, phenyl, benzyl, 2-phenyethyl, naphthyl, anthracenyl, phenanthrenyl, and the like; and mixtures thereof. The present toner material is suitable for color and black-white systems, electrophotographic imaging and printing systems, xerographic copiers and printers, including digital copiers, and the like.

Chemoselective treatment of the toner's surface-bound sulfonate groups can be accomplished with water-soluble silicates that include the cationic complexes of tetraalkylammonium and/or tetraalkylphosphonium, such as tetraethylammonium silicate, tetramethylammonium silicate, tetrabutylammonium silicate and tetrabutylphosphonium silicate. Tetramethylammonium silicate as shown in Formula 1 is available as an about 10% (as $SiO_2$) aqueous solution (SaChem, Austin, Tex.) with a pH of from about 11 to about 13. Silica dissolves above about pH 10.7 to about 11.0 and can therefore be prepared with organic bases such as TMA, which have dissociation constants greater that about $10^{-3}$. As well, these quaternary ammonium ions are most likely absorbed on the surface of the silica which is rendered hydrophobic when covered with this organic base. See, Iler, Ralph K. 1979. *The Chemistry of Silica: Solubility, Polymerization, Colloid and Surface Properties, and Biochemistry*. John Wiley & Sons, Inc. (New York), p. 150, 427, the disclosure of which is incorporated herein by reference in its entirety.

The quaternary ammonium cation, e.g. tetramethylammonium ("TMA"), ion exchanges with the complexed sodium cation (or other metal cation) for the sulfonate moieties on the toner surface, thereby creating a hydrophobic toner surface. Criteria in choosing a candidate compound for polyester EA toner surface treatment include: 1) costeffectiveness and commercially availability; 2) water solubility for in situ chemical surface treatment in aqueous media; 3) selective reactivity with the surface-bound sulfonate groups only; 4) efficacy in enhancing A-zone tribocharge level and/or reducing the C-zone tribocharge level and thereby reducing RH sensitivity ratio at least about 2-fold; and 5) chemical stability in the final surface-treated toner, without adversely affecting other toner properties such as fusing and color performance. It has been found that TMASi fits the criteria #1 through to #4; results are in progress for evaluation of toner fusing and color performance (i.e., #5).

Formula 1:

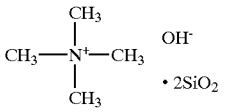

Tetramethylammonium silicate

This method includes chemoselective surface treatment of surface-bound sulfonate groups on EA polyester toners using water-soluble silicates that include the cationic complexes of tetraalkylammonium and/or tetraalkylphosphonium. The intent of the surface treatment method is to alter the toner particle surface chemistry by masking the sulfonate moiety, which is hydrophilic in nature, with a hydrophobic additive. This in turn will not alter the toner's overall morphology or effect it's fusing characteristics. Instead the toner will demonstrate enhanced negative tribocharging levels in high humidity A-zone (about 80 to 85% RH) and/or lower tribocharging levels in low humidity C-zone (about 20% RH) and therefore reduce the RH sensitivity ratio for tribocharging (ratio of C-zone-to-A-zone charge levels). Reaction 1 depicts the chemical reaction scheme for the surface treatment, which is performed, for example, in situ at the end of the EA polyester toner-making process.

Reaction 1:

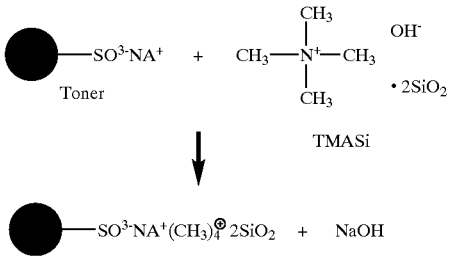

EA polyester toners suitable for use in the present invention include those disclosed in and taught by U.S. Pat. No. 6,143,457 to Carlini et al., the disclosure of which is incorporated herein by reference in its entirety.

Furthermore, the toner includes a colorant such as cyan, black, magenta, yellow dispersion, or mixtures thereof with from about 20 to about 60 weight percent solids of resin and colorant; a toner wherein the colorant is carbon black; a toner wherein the colorant is a dye; a toner wherein the colorant is a pigment; a toner wherein the colorant is composed of a mixture of a pigment and a dye; and a toner which contains surface additives composed of metal salts, metal salts of fatty acids, colloidal silicas, metal oxides, or mixtures thereof which additives are each optionally present in an amount of from about 0.1 to about 2 weight percent.

Various known colorants, especially pigments, present in the toner in an effective amount of, for example, including from about 1 to about 65, from about 2 to about 35 percent by weight of the toner, or from about 1 to about 15 weight percent, and wherein the total of all toner components is about 100 percent, include carbon black like REGAL 330.RTM.; magnetites such as Mobay magnetites MO8029.TM., MO8060.TM.; and the like. As colored pigments, there can be selected known cyan, magenta, yellow, red, green, brown, blue, or mixtures thereof. Specific examples of colorants, especially pigments, include phthalocyanine HELIOGEN BLUE L6900.TM., D6840.TM., D7080.TM., D7020.TM., cyan 15:3, magenta Red 81:3, Yellow 17, the pigments of U.S. Pat. No. 5,556,727, the disclosure of which is incorporated herein by reference in its entirety, and the like.

Examples of specific magentas that may be selected include, for example, 2,9-dimethyl-subsituted quinacridone and anthraquinone dye identified in the Color Index as CI 60710, CI Dispersed Red 15, diazo dye identified in the Color Index as CI 26050, CI Solvent Red 19, and the like. Illustrative examples of specific cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative specific examples of yellows that may be selected are diarylide yellow 3,3-dichlorobenzidene acetoacetamilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK.TM., and cyan components may also be selected as pigments with the present method. The colorants, such as pigments, selected can be flushed pigments as indicated herein.

More specifically, colorant examples include Pigment Blue 15:3 having a Color Index Constitution Number of 74160, magenta Pigment Red 81:3 having a Color Index Constitution Number of 45160:3, and Yellow 17 having a Color Index Constitution Number of 21105, and known dyes such as food dyes, yellow, blue, green, red, magenta dyes, and the like. Colorants include pigments, dyes, mixtures of pigments, mixtures of dyes, and mixtures of dyes and pigments, and the like.

Dry powder additives that can be added or blended onto the surface of the toner compositions optionally after washing or drying include, for example, metal salts, metal salts of fatty acids, colloidal silicas, metal oxides like titanium, tin and the like, mixtures thereof and the like, which additives are each usually present in an amount of from about 0.1 to about 2 weight percent, illustrative are U.S. Pat. Nos. 3,590,000; 3,720,617; 3,655,374 and 3,983,045, the disclosures of which are incorporated herein by reference in their entirety. Additives include zinc stearate and flow aids, such as fumed silicas like AEROSIL R9725.RTM. available from Degussa, or silicas available from Cabot Corporation or Degussa Chemicals, the coated silicas of application U.S. Ser. No. 09/132,623 pending and U.S. Pat. No. 6,004,714 and the like, each in amounts of from about 0.1 to about 2 percent, which can be added during the aggregation process or blended into the formed toner product.

Developer compositions can be prepared by mixing the toners with known carrier particles, including coated carriers, such as steel, ferrites, and the like, illustrative are U.S. Pat. Nos. 4,937,166 and 4,935,326, the disclosures of which are incorporated herein by reference in their entirety, for example from about 2 percent toner concentration to about 8 percent toner concentration.

Imaging methods are also compatible with the present toners, as illustrated by for example a number of the patents mentioned herein, and U.S. Pat. No. 4,265,990, the disclosure of which is incorporated herein by reference in its entirety.

The following Examples are being submitted to further define various species of the present invention in embodiments thereof. These Examples are intended to be illustrative only and are not intended to limit the scope of the present invention in embodiments thereof. Also, parts and percentages are by weight unless otherwise indicated.

In the following examples, the surface treatment of EA polyester toner is done in situ right after the aggregation-coalescence step. This aqueous toner slurry is ion-rich and ready to be doped with tetraalkylammonium and/or tetraalkylphosphonium silicate. The toner is gradually heated (with stirring) to about 40° C. and the diluted aqueous solution (about 1 to about 10%) of tetraalkylammonium and/or tetraalkylphosphonium silicate is added at approximately 1.0 milliliter/minute/100 grams toner solids. The quantity of TAA and/or TAP Si suitable for surface treatment includes from about 0.05% to about 15%, from about 5% to about 10%, about 5%, and about 10% by weight of dry toner mass.

Preliminary scoping experiments were conducted to assess the effectiveness of an example TAA silicate aqueous solution for enhancing the negative tribocharging level in the high humidity A-zone (about 80 to about 85% RH), as well as lowering the negative tribocharging level in the low humidity C-zone (about 20% RH) and thereby reducing the RH sensitivity.

COMPARATIVE EXAMPLE A

An about 5.87 μm ("micron") toner particle slurry composed of a sulfonated polyester resin and about 4% by weight of Flexiverse Blue (Pigment Blue 15:3) dispersion (Sun Chemical Co.) was prepared in the lab. The toner slurry was then filtered and washed two times with deionized water after mother liquor removal, resuspended and freeze-dried for about 48 hours to give the untreated lab-scale parent toner Comparative Toner A.

COMPARATIVE EXAMPLE B

An about 6.05 μm toner particle slurry composed of a sulfonated polyester resin and about 4% by weight of Flexiverse Blue (Pigment Blue 15:3) dispersion (Sun Chemical Co.) was prepared by the pilot plant. The toner slurry was then filtered and washed two times with deionized water after mother liquor removal, resuspended and freeze-dried for 15 about 48 hours to give the untreated parent toner Comparative Toner B.

EXAMPLE 1

An about 6.03 μm toner particle slurry composed of a sulfonated polyester resin and about 4% by weight of Flexiverse Blue (Pigment Blue 15:3) dispersion (Sun Chemical Co.) was prepared in the lab. An about 271.74 gram quantity of the aqueous toner suspension (about 14.72% by weight solids) in its mother liquor was preheated to about 40° C. A heated solution (about 20.0 grams; about 40° C.; concentration of about 5% by weight of dry toner; diluted to about 5% solids) of tetramethylammonium silicate (TMASi) was delivered via a peristaltic pump at a rate of about 2.0 milliliters/minute/100 grams toner solids to the stirring (about 190 to 200 rpm) aqueous toner suspension. After complete addition, the mixture continued stirring for about 30 minutes more while cooling to room temperature. The surface-treated Toner 1 was then filtered and washed two times after mother liquor removal. The filtercake was then resuspended to approximately 25% by weight solids and freeze-dried.

EXAMPLE 2

An about 6.05 μm toner particle slurry composed of a sulfonated polyester resin and about 4% by weight of Flexiverse Blue (Pigment Blue 15:3) dispersion (Sun Chemical Co.) was prepared by the pilot plant. An about 474.0 gram quantity of the aqueous toner suspension (about 10.55% by weight solids) in its mother liquor was preheated to about 40° C. A heated solution (about 50.0 grams; about 40° C.; concentration of about 10% by weight of dry toner; diluted to about 10% solids) of tetramethylammonium silicate (TMASi) was delivered via a peristaltic pump at a rate of about 2.0 milliliters/minute/100 grams toner solids to the stirring (about 190 to 200 rpm) aqueous toner suspension. After complete addition, the mixture continued stirring for about 50 minutes more while cooling to room temperature. The surface-treated Toner 2 was then filtered and washed two times after mother liquor removal. The filtercake was then resuspended to approximately 25% by weight solids and freeze-dried.

The treated toner in each of Examples 1 and 2 have a new glass transition temperature, when compared with the untreated parent toner, and can be characterized by FTIR and mass spectroscopy. Inductively coupled plasma ("ICP") was used as a silica detection technique, where parts-per-million ("ppm") of silica is converted to $SiO_2$ resulting in % incorporation of $SiO_2$ into toner. The treated toners are evaluated for tribocharging, fusing and color performance.

TABLE 1

Tribocharging Characteristics of TMASi Surface-Treated Sulfonated Polyester Toners (Carrier: Constellation carrier made with an XC rotary kiln powder coating process and containing about 1% Soken polymethylmethacrylate MP-116 on an about 65 μm steel core from Hoganas).

| | | q/m (μC/g) | | |
|---|---|---|---|---|
| Toner ID | Surface Treatment | 20% RH | 80% RH | RH Ratio |
| Comparative Example A | None | −148.5 | −21.3 | 7.0 |
| Comparative Example B | None | −130.6 | −13.0 | 10.1 |
| Example 1 | 5%-wt TMASi | −31.1 | −8.6 | 3.6 |
| Example 2 | 10%-wt TMASi | −22.0 | −7.5 | 2.9 |

The data presented in Table 1 highlights the reduced RH sensitivity ratio for toners in Examples 1 and 2 treated with about 5% and about 10% by weight tetramethylammonium silicate (TMASi), compared to the two reference toners, prepared in Comparative Examples A and B. The drop in about 20% RH tribocharging levels for both samples are contributing factors to the reduced RH sensitivity ratio. The about 80% RH tribocharging levels do drop as well but are not as significant as the about 20% RH levels.

TABLE 2

Glass Transition Temperatures and % $SiO_2$ Incorporation

| Toner ID | Tg (onset) | Tg (mid) | Tg (offset) | Si (ppm) | % $SiO_2$ |
|---|---|---|---|---|---|
| Comparative A | 54.7° C. | 59.2° C. | 63.8° C. | | |
| Comparative B | 54.8° C. | 59.2° C. | 63.7° C. | | |
| Example 1 | 53.1° C. | 57.4° C. | 61.7° C. | 19,409 | 83.1 |
| Example 2 | 51.9° C. | 55.3° C. | 58.6° C. | 37,856 | 81.0 |

The data presented in Table 2 show that the treated Toners 1 and 2 have new glass transition temperatures, when compared with untreated Comparative Toners A and B. The toner treated with about 10% by weight TMASi (Example 2) shows the lowest Tg values. As well, ICP results for ppm of silicate show about 81 to 83% incorporation when converted to % silicone dioxide.

TABLE 3

Fusing Properties of Toner 1 compared to Control Toner C (conventional polyester-based, cross-linked Constellation Xerox-type toner) and Control Toner D (conventional polyester-based dry pigment Majestic Fuji Xerox-type toner).

| Toner ID | T(G50) | Hot-Offset | MFT (Crease 30) | ΔT |
|---|---|---|---|---|
| Control C | 131 | >210 | 157 | 0 |
| Control D | 146 | >210 | 170 | +13 |
| Toner 1 | 158 | >210 | 153 | −4 |

The data presented in Table 3, as well as the gloss and crease curve are preliminary results for Toner 1. The gloss curve shows a large variation in some parts while other parts were flat—the reason for this variation is unknown. The ΔT (C30)=−5° C., which means that the surface treatment did not affect the crease fit and are comparable to the two controls (C and D). Thus, the fusing data suggests that by loading the polyester toner with about 5% by weight TMASi, the fusing properties do not notably change. The only unexplainable phenomenon is the abnormal gloss curve and will be verified with the about 10% by weight TMASi Toner 2 at a later date.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A chemical toner comprising a resin, colorant, and a silicate component chemically bound to the toner surface.

2. The toner of claim 1, wherein said silicate component comprises a water-soluble cationic complex of at least one of tetraalkylammonium and tetraalkylphosphonium.

3. The toner of claim 2, wherein said tetraalkylammonium comprises tetraethylammonium silicate, tetramethylammonium silicate, or tetrabutylammonium silicate.

4. The toner of claim 2, wherein said tetraalkylphosphonium comprises tetrabutylphosphonium silicate.

5. The toner of claim 1, wherein said silicate component is present in an amount of about 5 weight percent of the toner.

6. The toner of claim 1, wherein said silicate component is present in an amount of about 10 weight percent of the toner.

7. The toner of claim 1, wherein the resin is present in an amount of from about 80 to about 98 percent by weight of the toner, the colorant is present in an amount of from about 2 to about 20 weight percent of the toner, and the silicate component is present in an amount of from about 0.05 to about 15 weight percent of the toner.

8. A chemical toner comprising a sulfonated polyester resin, colorant, and a water-soluble silicate component ionically bound to surface sulfonate moieties on the toner.

9. The toner of claim 8, wherein said water-soluble silicate component comprises a cationic complex of at least one of tetraalkylammonium and tetraalkylphosphonium.

10. The toner of claim 9, wherein said tetraalkylammonium comprises tetraethylammonium silicate, tetramethylammonium silicate, or tetrabutylammonium silicate.

11. The toner of claim 9, wherein said tetraalkylphosphonium comprises tetrabutylphosphonium silicate.

12. The toner of claim 8, wherein the sulfonated polyester resin is present in an amount of from about 80 to about 98 percent by weight of the toner, the colorant is present in an amount of from about 2 to about 20 weight percent of the toner, and the water-soluble silicate component is present in an amount of from about 0.05 to about 15 weight percent of the toner.

13. A method of manufacturing a toner particle comprising (i) preparing a colloidal solution of a sulfonated polyester resin by heating water, adding a sulfonated polyester resin to the heated water, and cooling; (ii) adding a colorant to the colloidal solution, followed by heating the resulting mixture to a temperature equal to or higher than the resin glass transition temperature; (iii) adding thereto an aqueous solution of either an alkaline earth metal (II) salt or a transition metal salt whereby the coalescence and ionic complexation of sulfonated polyester colloid, colorant, and metal cation occur until the particle size of the composite is about 3 to about 10 microns in volume-average diameter having a geometric distribution of from about 1.13 to about 1.23; (iv) heating an aqueous slurry of said toner particle composite to a temperature of from about 25° C. to about 60° C. and chemically treating said toner particles in the heated aqueous slurry.

14. The method of claim 13, further comprising isolating, filtering, washing with water, and drying said toner.

15. The method of claim 13, wherein said aqueous solution containing a water-soluble silicate component is heated prior to said chemical treatment.

16. The method of claim 13, wherein said aqueous solution containing a water-soluble silicate component comprises from about 0.1% to about 10% solids.

17. The method of claim 13, wherein said aqueous solution containing a water-soluble silicate component comprises from about 0.1% to about 5% solids.

18. The method of claim 13, wherein said aqueous solution containing a water-soluble silicate component is added at approximately 1.0 milliliter/minute/100 grams of toner solids.

19. The method of claim 13, wherein step (iv) is performed in situ following step (iii).

20. The method of claim 13, wherein the polyester resin is present in an amount of from about 80 to about 98 percent by weight of the toner, the colorant is present from an amount of from about 2 to about 20 weight percent of the toner, and the water-soluble silicate component is present in an amount of from about 0.05 to about 15 weight percent of the toner.

* * * * *